US006149612A

United States Patent [19]

Schnapp et al.

[11] Patent Number: 6,149,612

[45] Date of Patent: Nov. 21, 2000

[54] REHABILITATIVE APPARATUS FOR TREATING REFLEX SYMPATHETIC DYSTROPHY

[76] Inventors: Moacir Schnapp, 5895 Garden Reach Cove, Memphis, Tenn. 38120; Kit S. Mays, 4715 Walnut Grove Rd., Memphis, Tenn. 38117

[21] Appl. No.: 09/152,576

[22] Filed: Sep. 14, 1998

[51] Int. Cl.[7] ..... A61H 1/00

[52] U.S. Cl. ..... 601/23; 601/5; 601/33; 601/40; 482/44; 482/45; 482/46; 482/47; 482/49

[58] Field of Search ..... 482/44, 45, 46, 482/47, 49, 1, 4, 5, 7, 9; 601/5, 23, 33, 40

[56] References Cited

U.S. PATENT DOCUMENTS

| | | | |
|---|---|---|---|
| 407,071 | 7/1889 | Hopkins . | |
| 1,899,255 | 2/1933 | Bell . | |
| 2,032,303 | 2/1936 | Orgitano | 601/23 |
| 2,387,966 | 10/1945 | Zander | 272/57 |
| 3,064,972 | 11/1962 | Feinn | 272/75 |
| 4,077,626 | 3/1978 | Newman | 272/128 |
| 4,337,050 | 6/1982 | Engalitcheff | 434/260 |
| 4,647,036 | 3/1987 | Huszcuk | 272/73 |
| 4,986,261 | 1/1991 | Iams et al. | 128/25 R |
| 5,039,091 | 8/1991 | Johnson | 272/131 |
| 5,186,695 | 2/1993 | Mangseth et al. | 482/6 |
| 5,720,711 | 2/1998 | Bond et al. | 601/23 |

*Primary Examiner*—Jerome W. Donnelly
*Assistant Examiner*—Tam Nguyen
*Attorney, Agent, or Firm*—Garvey, Smith, Nehrbass & Doody, L.L.C.

[57] ABSTRACT

The apparatus provides active and passive exercise to the hand, wrist and forearm of the patient. It has dual handles and an attached inertia apparatus such that both the affected arm and the non affected arm are subjected to the therapy. It is theorized that in the retraining of nerve, muscle and ligament/tendon function there is cross-training of right-left part of the systems and the healthy system can assist the afflicted part of the system in retraining. The apparatus addresses specifically the range of motion of the wrist, both for flexion-extension and pronation-supination. For pronation-supination, two conical handles, one for each hand is attached through an axis to a gear system connected to a flywheel. The gear/flywheel system allows for clockwise and counterclockwise rotations of the flywheel. The patient puts the system in motion by rotating the handles in either a clockwise or counterclockwise direction. The rotary (oscillating) motion is transferred to the flywheel through the gears. Adjustment of the starting position of the handle allows the patient to establish the starting point as the point where the patient's strength is maximal. The flywheel stores sufficient energy during the starting input of the patient to continue rotation after the patient's strength and range of motion decreases to the point that no further active rotation is produced by the patient. The inertia in the flywheel then continues the rotation of the patient's wrist, and effects a decrease in the tendon overload which normally occurs in normal physical therapy. An alternative embodiment includes a handle attachment for flexion and extension of the wrist with the orientation of the handle effectively at right angles to the flywheel gear drive of the prior embodiment, whereby the wrist is flexed and extended in causing oscillating rotary movement of the flywheel.

29 Claims, 7 Drawing Sheets

FIGURE 12
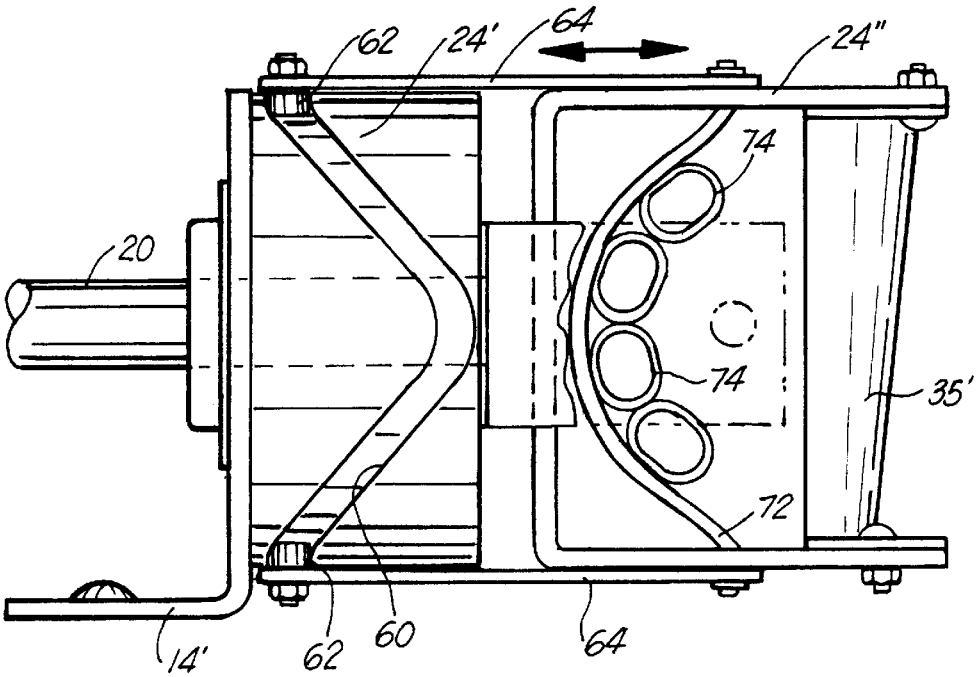
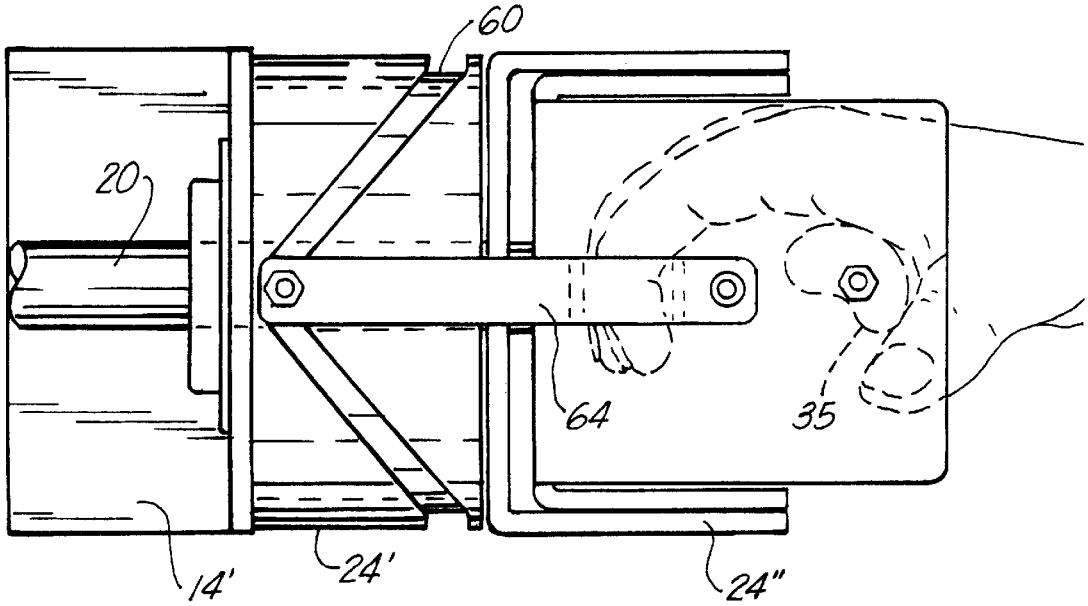
FIGURE 13

REHABILITATIVE APPARATUS FOR TREATING REFLEX SYMPATHETIC DYSTROPHY

CROSS-REFERENCE TO RELATED APPLICATIONS

Not applicable.

REFERENCE TO A "MICROFICHE APPENDIX"

Not applicable

STATEMENT REGARDING FEDERALLY SPONSORED RESEARCH OR DEVELOPMENT

Not applicable

BACKGROUND OF THE INVENTION

1. Field of the Invention

The present invention relates to physical therapy devices and more particularly to a rehabilitative apparatus for treatment of reflex sympathetic dystrophy and related disorders that cause weakness of muscles, joint stiffness, loss of mobility, pain and in severe cases, an atrophy of the associated tissue. Even more particularly, preferred embodiments of the present invention relate to improved apparatus for the treatment and rehabilitation of the effects of reflex sympathetic dystrophy involving the fingers, hands and limbs, including the joints of the wrists, elbows, ankles, knees, hips and shoulders. For those embodiments of the invention involving the hands, wrists and fingers, a pair of hand grips are attach to elongated shafts and, the distal ends of the shafts are attached through a gear system to a flywheel or equivalent inertial device. The gear and flywheel system allows for clockwise and counterclockwise rotations of the flywheel by rotation of the grips, involving a coordinated involvement of both hands and forearms. The patient puts the system in motion by rotating the handles in successive clockwise and counterclockwise directions. The afflicted portion of the limb uses, what residual strength is available. The inertia that has been input to the flywheel augments the movement of the limb past the afflicted limit, thereby extending the range of motion and functionality.

2. General Background of the Invention

Reflex sympathetic dystrophy (RSD) is a painfull condition usually arising from trauma involving nerves. In a typical example, a simple fracture of the wrist may hurt beyond what would normally be expected despite proper casting of the limb. In a few days the pain intensifies and assumes a constant burning quality, usually involving the whole limb. The skin may become sensitive to the point that light touch or even air from such as a fan causes excruciating pain. Distrophic changes ensue, initially with swelling, changes in color, temperature and appearance of the skin, followed by progressive atrophy of muscles, shortening of ligaments, ankylosing (or freezing) of the joints and later regional osteoporosis (or thinning) of the bone. The end result may be an inability to filly open or close the hand, limited rotation of the wrist for pronation/supination and flexion/extension. The ankle, elbow, knee and especially the shoulder joint may be similarly affected if related tissues are injured.

The current treatments universally include medications, nerve blocks and other similar modalities, but physical therapy is always necessary. Current physical therapy employs passive exercises such as having a therapist mobilize the affected limb. However, this therapy is limited by the patient's pain and fear of being hurt due to excessive manipulation by the therapist. Machines for continuous passive motion (CPM) were developed for stiff or surgically repaired joints but do not take into account the patient's intense pain and tissue sensitivity. We have determined that active exercises, by involving the brain, spinal cord, nerves and nerve-muscle junction are a more complete approach, and are necessary for the reeducation of the limb and reversal of the distrophic changes, not achieved through purely passive exercises.

In treating patients with RSD, we have found many have many developed "overuse syndromes" of the limb, mainly involving tendinitis from excessive exercises. It has become clear that the available exercise machines do not take into account the fact that these patients have to work not only against the machine's resistance, but also the internal resistance caused by the shortened muscles and ligaments as well as the stiffened and frozen joints.

We have developed a machine to address the specific needs of patients with RSD, although other medical conditions may benefit through use of the inventive apparatus. It is likely that treatment of the dystrophy from strokes, collagen diseases such as rheumatoid arthritis and similar injuries and abnormalities may be similarly effective as in RSD. The same principles used to treat the wrist as in the machine herein described, may be utilized to treat other areas of the body affected by RSD, such as the fingers, elbow, shoulder, ankle and the knee.

The inventive apparatus utilizes energy stored in an inertial device, such as a flywheel, to aid a patient's active exercises. Those skilled in the art will appreciate that other inertial devices including those electrically activated (as servo or stepping motors) may provide the inertial energy for the therapy. The machine's resistance is maximal initially, due to the flywheel's inherent inertia and it decreases rapidly with the resistance becoming negative at the end of the cycle (i.e., tending to continue the action). This allows the patient to start the exercise when the afflicted limb strength is maximal and joint stiffness and restriction are minimal. As the motion progresses, the internal resistance of the tissues increase and the patient's ability to accelerate the flywheel decreases. At that point the flywheel momentum carries the motion of the limb further, effectively providing a passive stretching of the tissues. By way of example, a patient who lacks forty-five degrees of mobility to fully supinate the hand (palm up) may start the motion of the apparatus with the hand fully pronated (palm down). By starting the action of the inventive apparatus with available joint strength, the apparatus may input the absorbed internal inertia back to the joint to carry it through to the weakened position, i.e., to reach the supinated position. The flywheel inertia will maintain the wrist rotation for a few more degrees until the internal resistance of the dystrophy affected tissues makes the wheel stop. The movement is therefore, active at the first portion of the cycle and passive at the end, preventing the inevitable overuse of muscles and ligaments in an active attempt to achieve a few more degrees of motion.

The inventive apparatus preferably is adapted for simultaneous bilateral operation, with concomitant pronation or supination of both limbs. This allows for a better retraining of the affected limb/joint, proprioception and coordination deficits benefitting from the communication between the right and left sides of the brain, restoring neural pathways compromised by the RSD. The use of the normal limb during the exercise may allow the central nervous system to use simultaneous bilateral use as a template to correct the incoordination of the malfunctioning limb/joint. The bilateral handles also allow the patient more strength to initiate the motion and more braking power to stop the rotation (oppose the inertia), effectively increasing the safety and making the apparatus more user friendly.

Pain is a significant deterrent to a patient's ability to exercise. Proper positioning of the limb/joint is a must. The inclusion of conical handles in the preferred embodiment allows for a more physiologic grasp, respecting the anatomy of a partially closed hand. In the preferred embodiment, the conical handles are attached to a gimbaled structure in order to permit the physiologic radial/ulnar deviation that occurs during pronation/supination.

Various patents have been issued for apparatus directed to physical therapy. None that we are aware of are directed to the special problems presented in the rehabilitation of a patient suffering from RSD. There are a variety of exercise machines, some including rehabilitation for occupational objectives. Early examples include the Hopkins U.S. Pat. No. 4,070,071 and the Bell U.S. Pat. No. 1,899,255. An apparatus directed specifically to mobilizing stiff joints is disclosed is U.S. Pat. No. 2,387,966 issued to Zander.

The Newman U.S. Pat. No. 4,077,626 provides an exercising apparatus that includes a platform, a bench mounted on the platform and adapted to provide a foot space on each side of the bench a bar traversing the bench attached at its ends to a pair of lines, a linear-to-rotational motion converter operably attached to said lines and adapted to convert the linear extension of said lines to rotational motion and to rewind said lines when said extension is relaxed, and a flywheel responsive to said linear-to-rotational motion converter and adapted so the pulling of said lines results in the rotation of said flywheel.

U.S. Pat. No. 4,337,050 issued to Engalitcheff provides a method and apparatus for rehabilitation of damaged limbs for use in operation of a tool, wherein accessories with handles corresponding to the handles of familiar tools are attached to a shaft in a manner such that the movements of the handle correspond to the normal operation of the tool product rotation of a shaft. A preselected resistance is applied to the rotation of the shaft by electrical, pneumatic, hydraulic, or mechanical means, and the resistance and the accessory attached can be varied in accordance with the capability of the damaged limb.

U.S. Pat. No. 4,647,036 issued to Huszczuk discloses a device for enabling the testing of a person's physical condition, by enabling measurement of the energy expended by the person to be tested thereby, in manually maintaining rotation of a flywheel in a stationary bicycle, against resistance applied to the flywheel, for use in determining the efficiency of the person's body in using energy, as an indication of such person's physical condition.

U.S. Pat. No. 4,809,970 issued to Beistegui provides and inertia mechanism for gymnastic bicycles having a pedaling axle. The mechanism includes an inertia flywheel and a set of cogged crowns of different diameters and different number of cogs mounted on the flywheel and operatively connected to each other and to the pedaling axle so that weight and the size reduction of the flywheel are counterbalanced by the set of the cogged crowns actuated upon the actuation of the pedaling axle.

Prior active exercise machines can induce overuse damage. There are several assisted passive devices used for rehabilitation such as a continuous positive motion or "CPM" devices, but they do not allow for the patient's control. They do not stimulate muscle use or proprioception.

BRIEF SUMMARY OF THE INVENTION

A principal object of the present invention is to aid in the rehabilitation of neuro-musculo-skeletal disorders involving the limbs. The present invention combines active and passive exercises, allowing the patient full control over the resistance and speed of exercise. In a preferred embodiment, the bilateral simultaneous use of opposite limbs, (e.g., both hands) as they are synchronously involved in the exercise regimen, enables the therapy to take advantage of the reeducation of the afflicted limb that occurs at the spinal and supraspinal centers induced by the healthy limb, thereby greatly benefitting impaired proprioception.

The present invention provides an apparatus specifically directed to the range of motion of the afflicted limb, which in the instance of the hand-wrist-forearm enables both flexion-extension and pronation-supination.

For pronation-supination, two conical handles, one for each hand, are attached through an axis to a gear system connected to a flywheel. This construction allows for synchronous clockwise and counterclockwise rotations. The patient puts the system in motion by rotating the flywheel in either direction, starting at the point where the patient's strength is maximal and the internal resistance due to joint stiffness and ligament shortening is minimal (i.e., the patient chooses the starting point). Should the patient's dystrophy be severe, the healthy limb may assist in initiating and/or stopping the rotation.

The flywheel stores enough energy to continue the movement after the patient's strength and range of motion decrease to the point that no further active rotation is produced by the patient. This apparatus thus effectively allows for further rotation of the wrist than what the patient could do by his or her own means, and decreases the tendon overload that frequently occurs during normal physical therapy.

In the bilateral hand/wrist/forearm embodiment both handles are connected and, in general, both hands should operate simultaneously with the healthy hand aiding in initiating and stopping the rotation, for enhanced benefit and faster progress as well as additional safety (further braking control by the patient). An object of the present invention is to thus obtain the fastest improvement with the minimum of sequela. As related above, an important benefit of such bilateral simultaneous use is the reeducation of the affected limb that occurs at the spinal and supraspinal centers, to improve the impaired impaired proprioception.

For an alternative embodiment for flexion-extension of the wrist, the same principles apply. A conical handle operates through gears attached to an axis that rotates a flywheel that stores enough energy to continue in the same direction of movement, thus enabling flexion or extension of the wrist beyond the patient's impaired capabilities however, avoiding overuse of the musculo skeletal system. Bilateral handles will thus be preferably employed for the flexion-extension portion of the apparatus.

An alternative embodiment for flexion and extension of the fingers of the hand is also disclosed. In this embodiment, the fingers are disposed in sleeves of a support adjacent the generally conical handle, against which the palm is placed. The sleeved finger support is adapted for longitudinal reciprocal movement as the hand inputs the reciprocal rotary motion into the inertial exerciser, whether in pronation-supination or a flexion-extension exercise.

Alternative embodiments for other limbs, providing therapy to the ankle, elbow, knee and shoulder involve similar reciprocal rotary motion providing a reciprocal exercise of the tissues serving the joint wherein the remaining strength of the limb is utilized by the patient for a patient-driven exercise, inputting inertia into the inventive apparatus to assist the patient to effect a continued movement of the joint and involved tissues to vitalize and re-educate them to normal function. Preferred embodiments of such additional apparatus will involve bilateral exercise of the targeted limbs for the reeducation that occurs at the spinal and supraspinal centers.

BRIEF DESCRIPTION OF THE DRAWINGS

FIG. 12 is a fragmentary side elevational view of the apparatus of FIG. 11; and FIG. 13 is a fragmentary top view of the apparatus of FIG. 11.

For a further understanding of the nature, objects, and advantages of the present invention, reference should be had to the following detailed description, read in conjunction with the following drawings, wherein like reference numerals denote like elements and wherein:

DETAILED DESCRIPTION OF THE INVENTION

Figure 1:
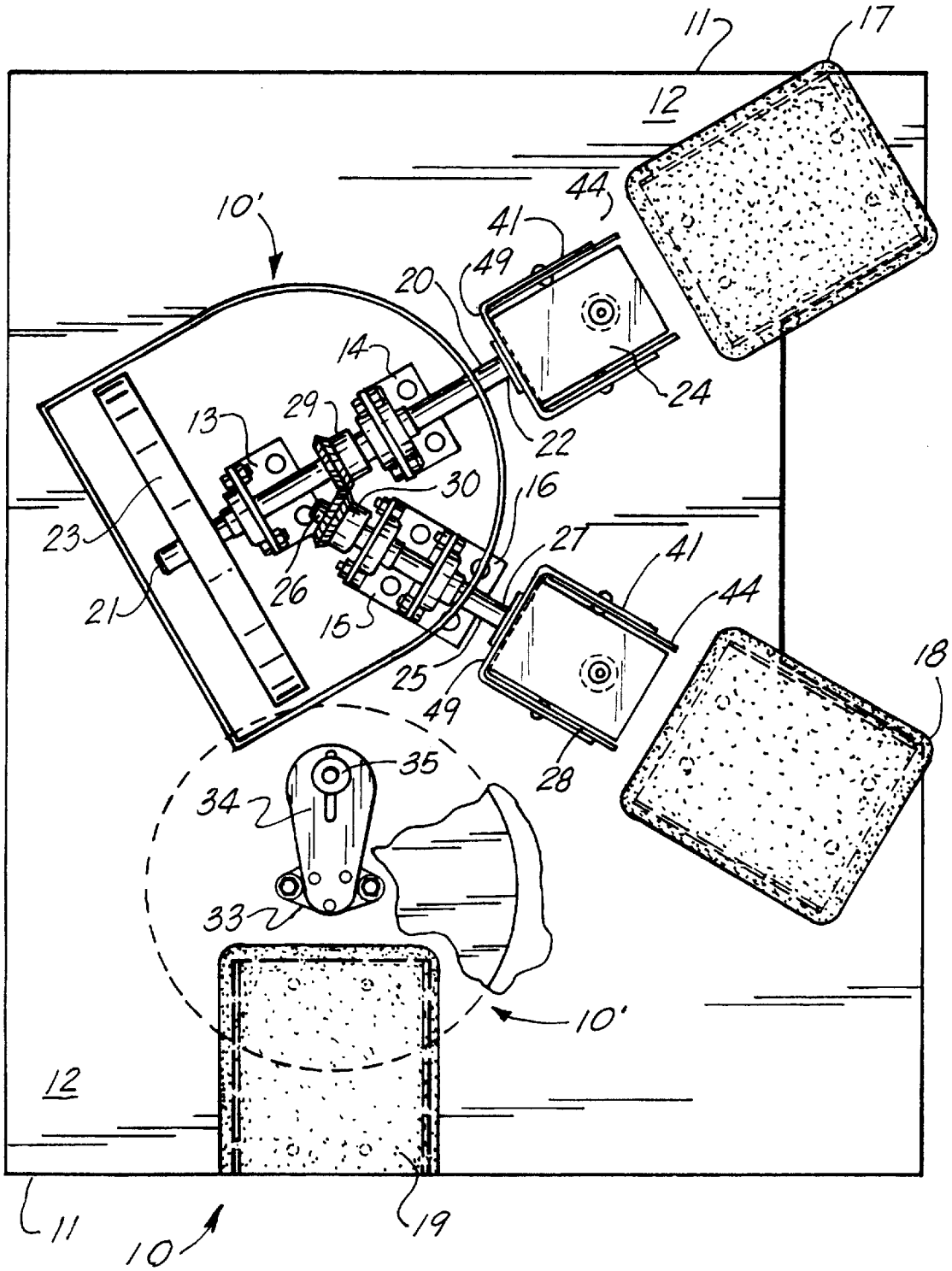
FIG. 1 is a top plan view of the preferred embodiment of the apparatus of the present invention for pronation-supination and flexion-extension therapy of the wrist.

FIG. 1 shows the preferred embodiment of the apparatus of the present invention adapted for pronation-supination therapy and for flexion-extension therapy of the wrist, designated generally by the numeral 10. The embodiment of rehabilitative apparatus 10 for treatment of reflex sympathetic dystrophy (RDS) shown in FIG. 1 includes a frame that can be, for example, in the form of a table 11 having an upper surface 12. Pronation/supination apparatus 10' is disposed on table 11 which carries a plurality of support brackets 13–16 that extend from the table's 11 upper surface 12. Support brackets 13–16 include a first pair of support brackets 13, 14 that support shaft 20 and a second pair of support brackets 15, 16 that support shaft 25. A pair of arm rest pads 17, 18 are shown in FIG. 1 aligned generally with respective shafts 20, 25. A third arm rest pad 19 is positioned next to vertical shaft 32, bearing 33 and arm 34 that carries conical handle 35 for flexion-extension exercise.

Figure 2:
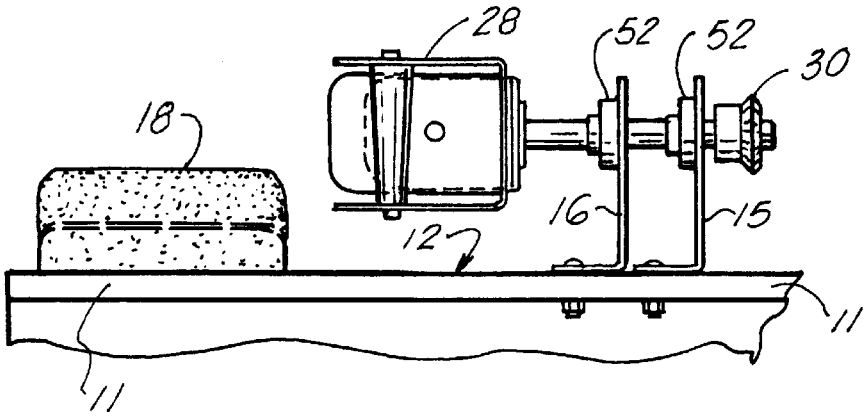
FIG. 2 is a fragmentary elevational view of the preferred embodiment of the apparatus of the present invention for pronation-supination therapy.
Figure 4:
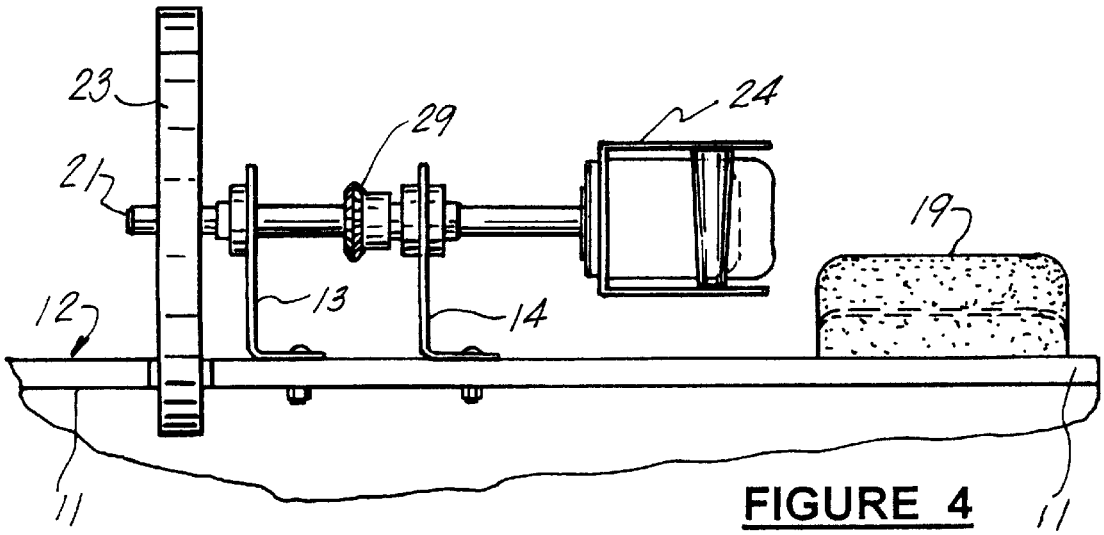
FIG. 4 is a side elevational view of the preferred embodiment of the apparatus of the present invention for pronation-supination therapy.

Shaft 20 provides end portions 21, 22. Flywheel 23 is mounted to end 21 of shaft 20. Shaft 25 has end portions 26, 27. A pair of grips 24, 28 are affixed respectively to shafts 20, 25 at respective end portions 22, 27 as shown in FIGS. 1, 2 and 4.

The shafts 20, 25 are joined so that they rotate together. A pair of miter gears 29, 30 are provided respectively upon shafts 20, 25. The shaft 20 carries a miter gear 29 at the mid-portion of the shaft 20 as shown in FIG. 1. The miter gear 30 is carried at the end 26 portion of shaft 25. The arrangement and placement of miter gears is one of convenience for those skilled in the art. The essential feature for bilateral therapy is accomplished by linking the rotation of the shafts 20, 25. Thusly, when one of the shafts 20 is rotated, the miter gears 29, 30 ensure that other shaft will also rotate. This is an important aspect of the present invention because during bilateral physical therapy, a patient rotates one of the shafts using a grip 24 or 28 with one of the patient's hands while the other hand receives the benefit of the synchronous rotation.

The other hand must then also rotate if it is gripping the other grip. The patient puts the pronation-supination system 10' in motion by rotating in either direction, starting at the point where the patient's strength is maximal and the internal resistance due to joint stiffness and ligament shortening is minimal (i.e. the patient chooses the starting point). The flywheel 23 stores enough energy to continue movement after the patient's strength and range of motion decreases to the point that no further active rotation is produced by the rotation. This construction effectively allows for further rotation of the wrist than what the patient could accomplish singly by his or her own means, and decreases the tendon overload that occurs during normal physical therapy. Because both of the grips 24, 28 and the shafts 20, 25 to which they are attached are connected for rotation, both hands operate simultaneously with the healthy hand aiding and initiating in stopping the rotation, for enhanced benefit and faster progress as well as additional safety (further breaking control by the patient). Thus, an object of the apparatus 10 of the present invention is to obtain the fastest improvement. An important benefit of bilateral simultaneous use, is the reeducation of the affected limb that occurs at the spinal and supraspinal centers, to improve the impaired impaired proprioception.

Figure 9:
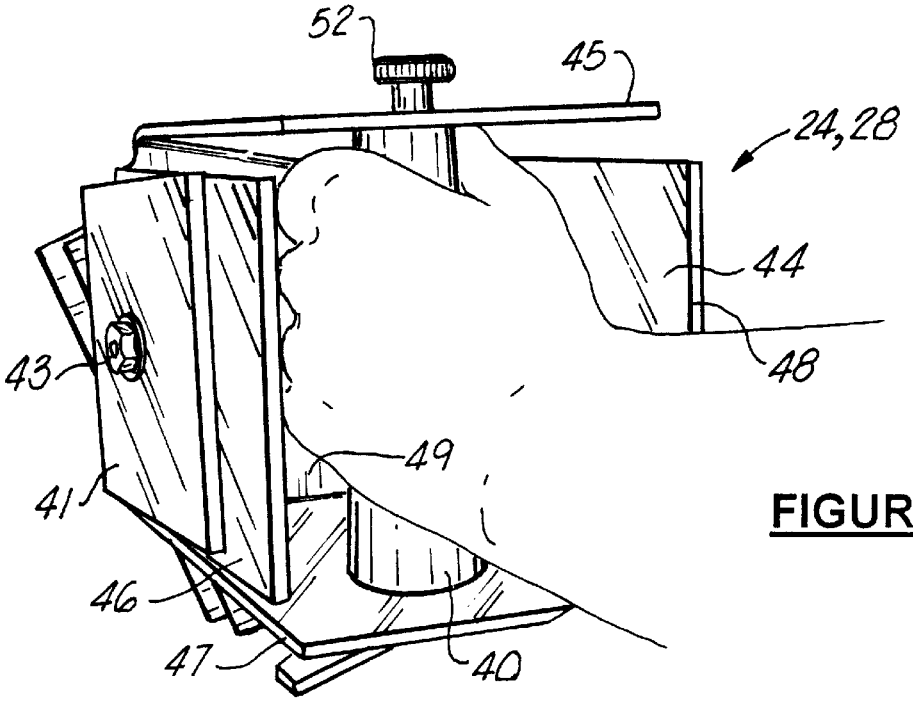
FIG. 9 is a fragmentary perspective of the preferred embodiment of the apparatus of the present invention illustrating the handle, grip bracket and gimbal bracket portions thereof.

Each of the grips 24, 28 provides a conical-shaped grip handle 40. A gimbal arrangement is provided in the form of a grip bracket 44 that is mounted in gimbal fashion to a gimbal bracket 41. Bolted connections 42,43 are provided for affixing the gimbal bracket 41 and the grip bracket 44 together. In the illustrated embodiment, gimbaled bracket is adapted to allow wrist rotation of about plus and minus five degrees in the plane perpendicular to shaft 20, 25 however, more wrist rotation may be provided for. The grip bracket 44 includes a plurality of side plates 45, 46, 47, 48 as shown in FIG. 9. The grip bracket 44 also includes an end plate 49 that is attached to and rotates with the respective shaft 20 or 25. These features are preferred, though not necessary, since the grip handle provides a more anatomical fit to the hand. The conical handle 40 is disposed such that the thumb and fore and index fingers grip the larger diameter portions of the handle while the shorter ring and little fingers grip the smaller diameter part of handle 40. Grips 24,28 are preferably gimbaled to accommodate the natural rotation of the wrist in a plane essentially perpendicular to the plane of pronation-supination rotation.

Figure 8:
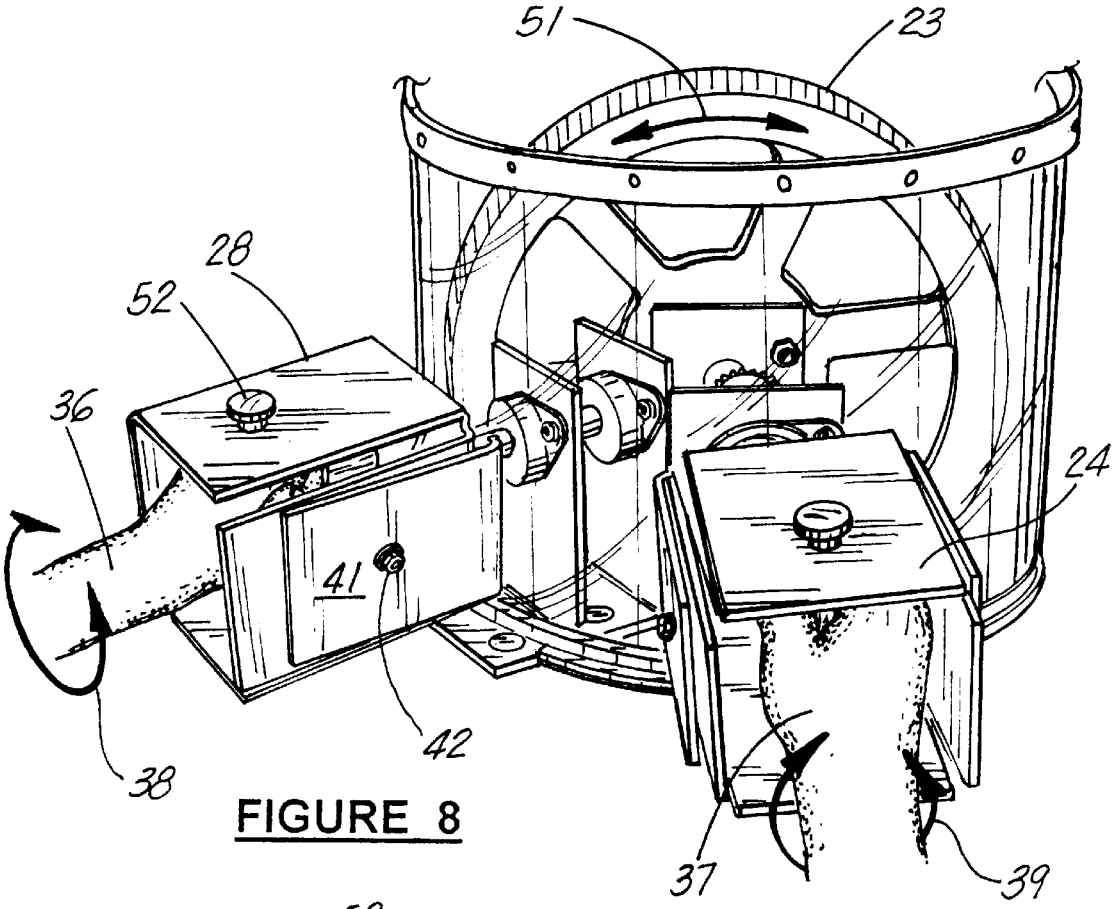
FIG. 8 is a perspective of the preferred embodiment of the apparatus of the present invention for pronation-supination therapy.

In FIGS. 8 and 9, a patient's left 36 and right 37 hands are shown gripping the handles 40 of grips 28 and 24. Handles 40 can be attached to grip brackets 44 using bolted connections 52 for example. Curved arrows 38, 39 illustrate simultaneous rotation and pronation-supination of the hands 36, 37. Rotation of the user's hands 37, 38 produces a rotation of the flywheel 23 as shown by arrow 51 in FIG. 8. Bearings 53 can be provided at the interface between brackets 13, 14, 15, 16 and shafts 20, 25.

Figure 3:
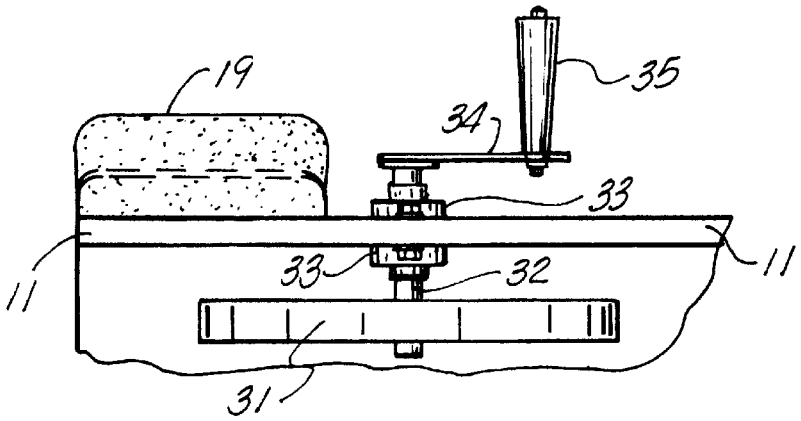
FIG. 3 is a fragmentary elevational view of the preferred embodiment of the apparatus of the present invention for flexion-extension therapy.

The present invention 10 in a separate aspect includes flexion/extension apparatus 10" which enables a patient to address a range of motion of flexion-extension for the wrists as shown in FIGS. 1, 3, and 5–7. For flexion-extension exercises, the patient's hand 37 grips handle 35 that is attached to radially extending arm 34. Arm 34 is mounted at bearing 33 to table 11 at upper surface 12. A bearing 33 can also be provided to the underside of table 11 as shown in FIG. 3. Vertical shaft 32 extends from radially extending arm 34 through bearings 33 to flywheel 31. FIG. 1 illustrates flexion/extension apparatus 10" included in table 11 with pronation/supination apparatus 10' however, the scope of the invention contemplates that either pronation/supination apparatus 10' or flexion/extension apparatus 10" may be housed or carried separately, as in table 11.

Figure 5:
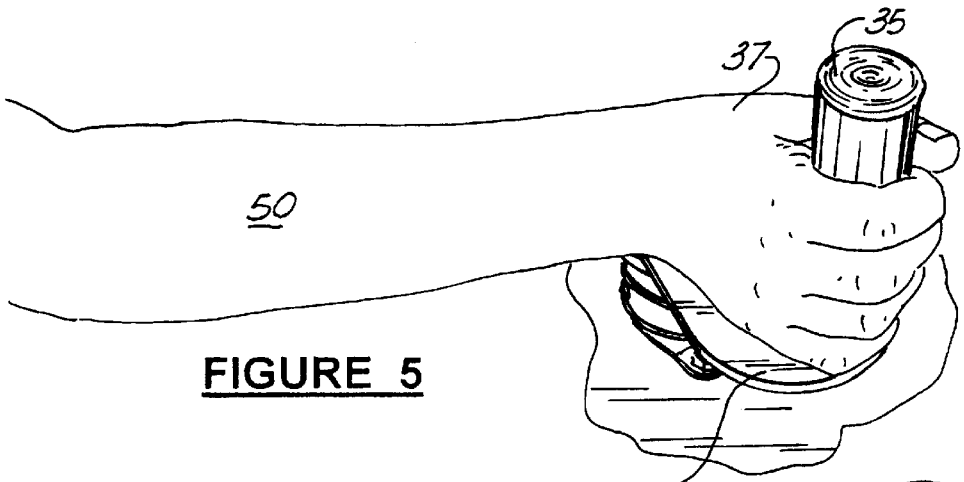
FIGS. 5–7 are perspective fragmentary views of the preferred embodiment of the apparatus of the present invention illustrating flexion and extension of the wrist.
Figure 6:
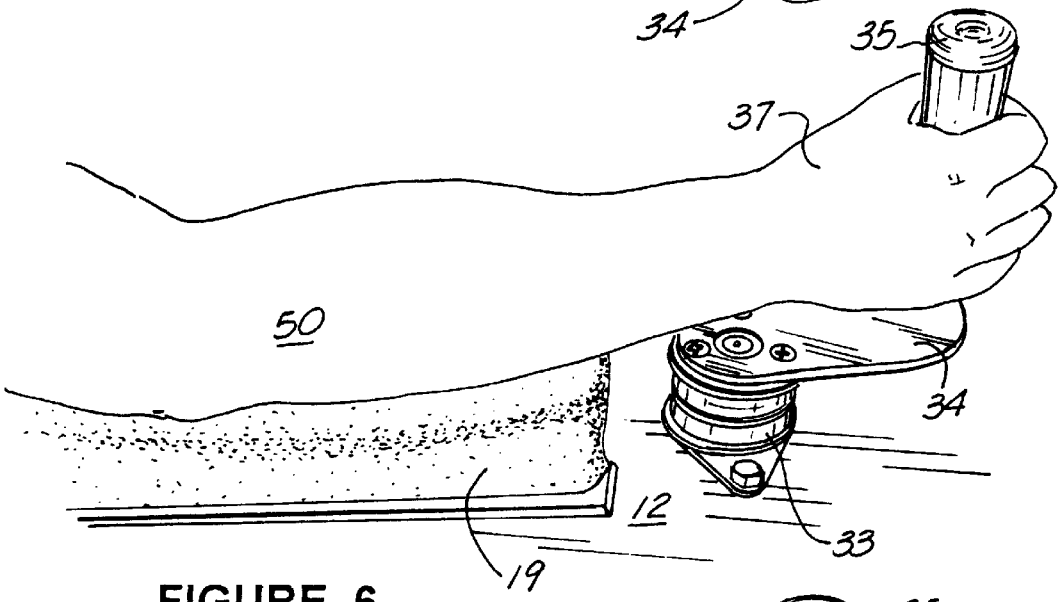
Figure 7:
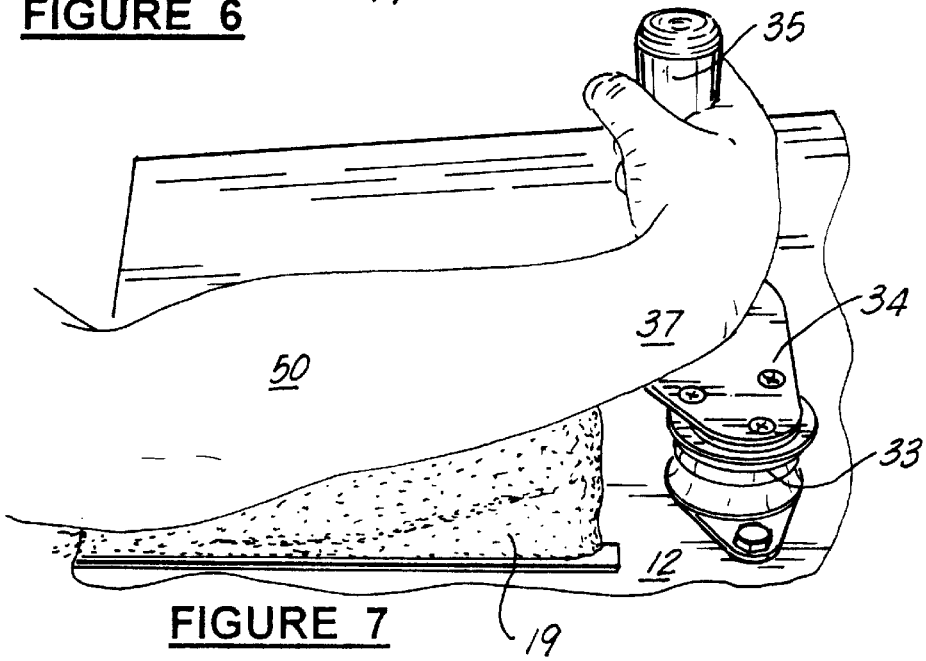
Figure 10:
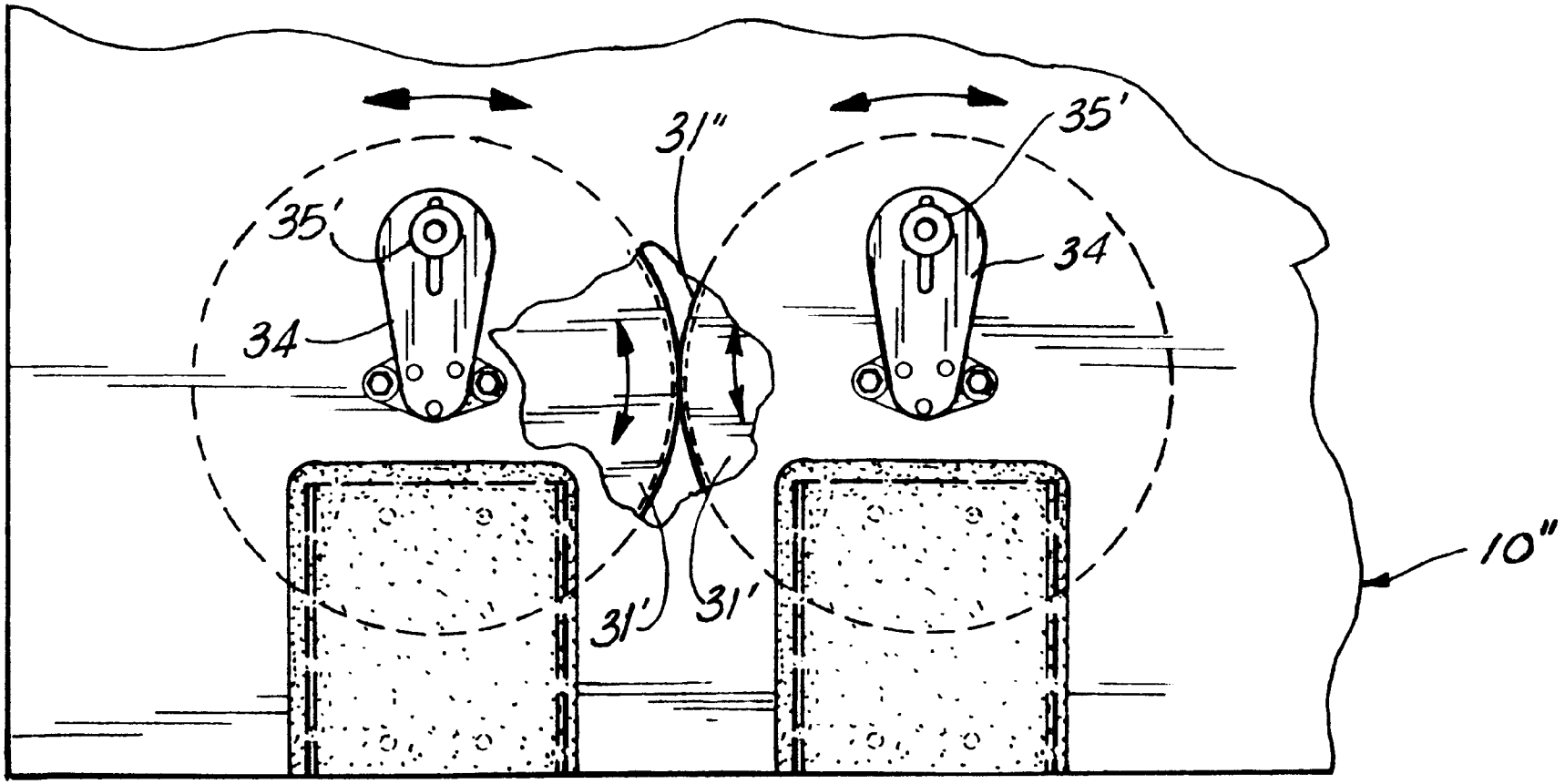
FIG. 10 is a fragmentary top plan view of an embodiment of the apparatus of the present invention for bilateral wrist flexion/extension therapy.

In FIGS. 5–7, the patient is shown using a flexion-extension of the wrist. The conical handle 35 operates through shaft 32 attached to and on an axis that rotates flywheel 31 that stores enough energy to continue the same direction of movement. This action forces flexion or extension of the wrist of the patient beyond the patient's capabilities and avoiding overuse of the musculo skeletal system, similar to pronation/supination apparatus 10'. While the unilateral handle 35 is shown in FIGS. 3 and 5–7, a bilateral arrangement can also be employed. Such an embodiment is illustrated in FIG. 10. As with the bilateral apparatus 10' for pronation-supination, the bilateral flexion-extension apparatus 10" includes an inertial device (e.g. twin flywheels 31') in geared, coupled relation as at 31" with grips 35'. As with the embodiment of FIGS. 1–2, 4 and 8–9, gears can be used to interconnect a single flywheel with the illustrated two vertical shafts 32 and the connected handles and arms 34, 35. While flexion/extension apparatus 10" is illustrated as having interlocking flywheels 31', it is within the scope of the invention that a single flywheel 31' may be utilized, in geared relation with associated grips as is illustrated for pronation/supination apparatus 10'.

Figure 11:
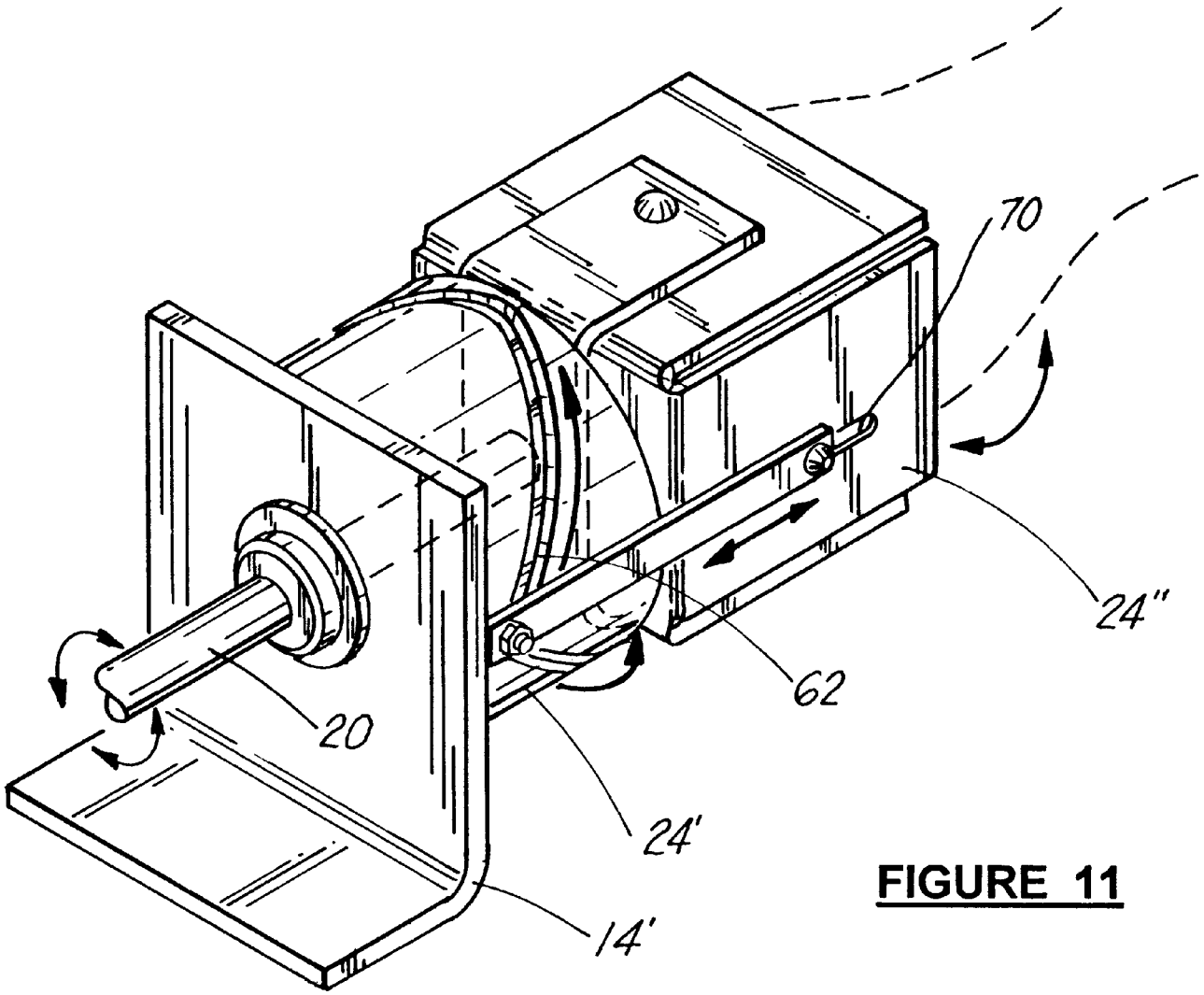
FIG. 11 is a fragmentary perspective view of a preferred embodiment of the apparatus of the present invention illustrating pronation-supination therapy including finger flexion-extension.

FIGS. 11–13 illustrate a still further therapy regimen to the illustrated embodiments of the present invention. It is desirable in many RSD therapy regimens involving the wrist to also be able to provide for flexion-extension of the fingers. By adding this further treatment to the inertial style of exercise of the present invention, more of the muscle, tendon and ligament tissues of the hand and forearm may be involved, adding prospect for a more complete recovery to the syndrome. The illustrated modification of the grip 24 (and grip 28, not shown) is segmented, into segments 24' and 24". For ease in construction, as will be understood by those skilled in the art, segment 24' is of cylindrical in cross section, and is firmly affixed to brackets 14'. Cam track 60 is disposed in grip segments 24' to slidably receive a tracking cam such as the illustrated bearing/wheel 62 disposed on longitudinal supports 64,68. Grip segment 24" is disposed on shaft 20 in a manner similar to grips 24, 28 of pronation/supination apparatus 10' (FIG. 1) such that as a patient's hand may provide and receive the rotary motion input to the apparatus 10'. Longitudinal support 64 is slidably mounted in grip segment 24" in such as slots 70, and have disposed in bridging relation finger support 72 having disposed thereon individual finger grips 74. As will be evident from FIGS. 12 and 13, finger support 72 is disposed adjacent and generally parallel to grip 35' so that as finger support is reciprocated by the longitudinal tracking of cam wheels 62 in cam tract 60, a patient's fingers will be flexed and extended as finger support, toward and away from handle 35' with the patient's palm resting firmly thereon as the wrist reciprocates in pronation-supination.

The following table lists the parts numbers and parts descriptions as used herein and in the drawings attached hereto.

PARTS LIST

| Part Number | Description |
|---|---|
| 10 | rehabilitative apparatus |
| 10' | pronation/supination apparatus |
| 10" | Flexion/extension apparatus |
| 11 | table |
| 12 | upper surface |
| 13 | support bracket |
| 14 | support bracket |
| 15 | support bracket |
| 16 | support bracket |
| 17 | arm rest pad |
| 18 | arm rest pad |
| 19 | arm rest pad |
| 20 | shaft |
| 21 | end |
| 22 | end |
| 23 | flywheel |
| 24 | grip |
| 25 | shaft |
| 26 | end |
| 27 | end |
| 28 | grip |
| 29 | miter gear |
| 30 | miter gear |
| 31 | flywheel |
| 31' | bilateral flywheel |
| 31" | geared flywheel perimeter |
| 32 | vertical shaft |
| 33 | bearing |
| 34 | arm |
| 35 | conical handle |
| 35' | finger flexion handle |
| 36 | patient's left hand |
| 37 | patient's right hand |
| 38 | arrow |
| 39 | arrow |
| 40 | conical handle |
| 41 | gimbal bracket |
| 42 | bolted connection |
| 43 | bolted connection |
| 44 | grip bracket |
| 45 | side plate |
| 46 | side plate |
| 47 | side plate |
| 48 | side plate |
| 49 | end plate |
| 50 | user's right forearm |
| 51 | arrow |
| 52 | bearing |
| 60 | cam track |
| 62 | cam follower wheel |
| 64 | longitudinal support |
| 70 | slot |
| 72 | finger support |
| 74 | finger grips |

The foregoing embodiments are presented by way of example only; the scope of the present invention is to be limited only by the following claims.

What is claimed is:

1. A rehabilitative apparatus for treatment of reflex sympathetic dystrophy comprising;

a) a frame that has an upper surface;

b) a plurality of support brackets extending above the frame upper surface and anchored thereto during use;

c) a pair of shafts supported for rotary motion by the brackets in a position spaced above the upper surface;

d) each of said shafts having a proximal end portion having a grip handle disposed thereon to be gripped by a user;

f) each of said shafts having a distal end portion and a rotary gear disposed thereon;

h) a gear transmission arrangement that joins the gears of the distal end portions of the respective shafts so that when one of the shafts rotates, the other shaft is rotated; and i) a flywheel attached to the output of said gear transmission for storing energy transmitted to one of the shafts by the user.

2. The rehabilitative apparatus for treatment of reflex sympathetic dystrophy of claim 1, wherein the shafts rotate at about the same rotational speed.

3. The rehabilitative apparatus for treatment of reflex sympathetic dystrophy of claim 1, further comprising a gimbal for joining the handles to the shafts.

4. The rehabilitative apparatus for treatment of reflex sympathetic dystrophy of claim 1, wherein the gear arrangement includes a pair of miter gears carried by the distal ends of the shafts.

5. The rehabilitative apparatus for treatment of reflex sympathetic dystrophy of claim 1, wherein the shafts form an acute angle with respect to each other.

6. The rehabilitative apparatus for treatment of reflex sympathetic dystrophy of claim 1, wherein the upper surface is generally flat and the shafts are parallel to the upper surface.

7. The rehabilitative apparatus for treatment of reflex sympathetic dystrophy of claim 1, further comprising a vertical shaft mounted through the frame and extending above the upper surface, said vertical shaft carrying a flywheel and a conical handle.

8. The rehabilitative apparatus for treatment of reflex sympathetic dystrophy of claim 1, wherein the user can rotate one of the grip handles for pronation and supination of one of the user's hand and wrist which automatically results in the pronation and supination of the user's other hand and wrist.

9. The rehabilitative apparatus for treatment of reflex sympathetic dystrophy of claim 1, wherein the shafts form an angle of about sixty degrees with respect to each other.

10. A rehabilitative apparatus for treatment of reflex sympathetic dystrophy comprising;

a) a frame that has an upper, generally flat surface;

b) a plurality of support brackets attached to and extending above the frame upper surface;

c) a pair of shafts supported by the brackets in a position spaced above the upper surface, the shafts forming an acute angle;

d) each of the shafts having a proximal end portion that provides a grip handle to be gripped by a user;

f) each of the shafts having a distal end portion;

h) a transmission for reciprocal rotary motion that joins the distal end portions of the respective shafts so that when one of the shafts rotates axially, the other shaft is rotated axially; and i) one of the shafts carrying a flywheel for storing non-motorized energy transmitted to one of the shafts by the user, the other shaft and attached handle being driven with only energy transmitted to it from the flywheel via the transmission.

11. The rehabilitative apparatus for treatment of reflex sympathetic dystrophy of claim 10 wherein at least one of the handles has a conically shaped outer surface.

12. The rehabilitative apparatus for treatment of reflex sympathetic dystrophy of claim 10, wherein each handle is mounted in a housing that includes a socket for receiving a user's hand, and said housing is mounted via a gimbal to the shaft.

13. The rehabilitative apparatus for treatment of reflex sympathetic dystrophy of claim 10, further comprising a vertical shaft mounted through the frame and extending above the upper surface, said vertical shaft carrying a flywheel and a conical handle.

14. The rehabilitative apparatus for treatment of reflex sympathetic dystrophy of claim 10, wherein the transmission includes a pair of miter gears carried by the distal ends of the shafts.

15. A method of treating reflex sympathetic dystrophy in a patient comprising the steps of:

(a) providing an exercise machine that includes a gear system and a pair of shafts with a respective pair of attached handles that can be gripped by the patient;

(b) gripping the handles;

(c) rotating the shafts with the handles so that both of the shafts rotate simultaneously;

(d) using the gear system to couple said shafts for synchronous rotary movement;

(e) wherein the patient's stronger hand may control the rotation of the shafts and their angular degree of rotation.

16. The method of claim 15 wherein in the steps of "b" and "c", the patient's hands pronate and supronate.

17. The method of claim 15 wherein in the steps "b" and "c", the patient's wrists flex and extend.

18. The method of claim 15 wherein in step "a", one of the shafts include a flywheel for storing rotary energy.

19. The method of claim 15 wherein said handles and shafts which are oriented in an acute angle with respect to each other are rotated by the patient.

20. The method of claim 15 wherein the patient's hands grip gimbaled handles in rotating said shafts.

21. The method of claim 16 further comprising the step of positioning the patient's arms generally parallel to the respective shafts.

22. A rehabilitative apparatus for rehabilitating a human joint and associated limbs comprising:

a) an non-motorized inertial device for providing reciprocating resistance to energy input from a user's limb;

b) a shaft having a shaft axis and a distal end operatively connected to said inertial device for manually inputting reciprocating motion into said inertial device;

c) a coupling member connected to the proximal end of said shaft, said coupling member adapted to be connected to a user's limb;

d) a limb support positioned next to the shaft and coupling member, said limb support including a support surface that is generally perpendicular to the axis of said shaft;

e) whereby the coupling member enables the user's limb to input energy through said coupling member and said shaft into said inertial device to thereby initiate motion in said inertial device in a first direction; and f) wherein the coupling member enables the user thereby to reverse the direction of shaft travel and input energy being input into said inertial device to cause reciprocal motion in a second direction in said inertial device by only overcoming said input energy.

23. The rehabilitative apparatus of claim 22 wherein said inertial device develops rotary motion from input energy to preliminarily rotate the shaft in a first rotational direction.

24. The rehabilitative apparatus of claim 23 wherein said coupling means includes a handle to be grasped by the hand of a user for rehabilitation of the user's wrist.

25. The rehabilitative apparatus of claim 22 wherein said inertial device develops linear motion from input energy.

26. The rehabilitative apparatus of claim 25 wherein said coupling means includes a handle having means for holding the fingers for rehabilitation of the finger joints.

27. A rehabilitative apparatus for rehabilitating a human joint and associated limbs comprising:

a) an inertial device for providing reciprocating resistance to energy input from a human limb;

b) a shaft having a distal end operatively connected to said inertial device for manually inputting reciprocating motion into said inertial device;

c) a coupling member connected to the proximal end of said shaft, said coupling member adapted to be connected to a limb;

d) whereby the human limb may input energy through said coupling member and said shaft into said inertial device to initiate motion in said inertial device; and reverse the input energy being input into said inertial device to cause reciprocal motion in said inertial device wherein said inertial device is a reciprocating flywheel.

28. The rehabilitative apparatus of claim 22 having two couplings, each connected to the proximal end of a shaft and said shafts are connected to said inertial device in geared relation whereby the coupling members synchronously transmit energy input from a limb to said inertial device.

29. The rehabilitative apparatus for treatment of reflux sympathetic dystrophy of claim 1, wherein rotation of one handle results in proration and supination of the user's hand and wrist.

* * * * *